US010317081B2

(12) United States Patent
Hoke

(10) Patent No.: US 10,317,081 B2
(45) Date of Patent: Jun. 11, 2019

(54) FUEL INJECTOR ASSEMBLY

(75) Inventor: James B. Hoke, Tolland, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 664 days.

(21) Appl. No.: 13/014,480

(22) Filed: Jan. 26, 2011

(65) Prior Publication Data

US 2012/0186259 A1 Jul. 26, 2012

(51) Int. Cl.
*F23R 3/28* (2006.01)
*F23D 11/10* (2006.01)
*F23R 3/14* (2006.01)

(52) U.S. Cl.
CPC ..... *F23R 3/28* (2013.01); *F23D 11/107* (2013.01); *F23R 3/14* (2013.01); *F23D 2900/11101* (2013.01); *F23R 3/283* (2013.01)

(58) Field of Classification Search
CPC .. F23R 3/28; F23R 3/286; F23R 3/283; F23R 3/30; F23R 3/32; F23R 3/34; F23R 3/343; F23R 3/346; F23R 3/36; F23R 3/38; F23R 3/12; F23R 3/14; F23D 11/107; F23D 17/002; F23D 2900/11101; Y02T 50/675; F23C 7/004
USPC ..... 60/737, 740, 742, 743, 748; 239/399, 239/419
See application file for complete search history.

(56) References Cited

U.S. PATENT DOCUMENTS 2,595,759 A * 5/1952 Buckland et al. ..... 239/403
2,945,629 A * 7/1960 Chute et al. ..... 239/423
3,703,259 A * 11/1972 Sturgess et al. ..... 239/400
3,946,552 A * 3/1976 Weinstein et al. ..... 60/743
3,972,182 A * 8/1976 Salvi ..... F23R 3/14 239/404
3,980,233 A * 9/1976 Simmons ..... F23D 11/107 239/400
4,265,085 A 5/1981 Fox et al.
4,327,547 A * 5/1982 Hughes et al. ..... 60/39.463
4,773,596 A 9/1988 Wright et al.
4,817,389 A 4/1989 Holladay et al.
4,941,617 A 7/1990 Russell
4,991,398 A 2/1991 Clark et al.
5,044,559 A * 9/1991 Russell et al. ..... 239/406
5,078,324 A 1/1992 DuBell et al.
5,237,820 A * 8/1993 Kastl et al. ..... 60/752
(Continued)

FOREIGN PATENT DOCUMENTS

CA 2379110 A1 * 11/2001 ..... F23R 3/14
CA 2533045 A1 * 9/2006 ..... F23C 5/02
(Continued)

OTHER PUBLICATIONS

English Translation to Abstract for GB2404976.
European Search Report for Application No. 12152545.5; dated Dec. 23, 2015.

*Primary Examiner* — Ehud Gartenberg
*Assistant Examiner* — Thomas P Burke
(74) *Attorney, Agent, or Firm* — Cantor Colburn LLP

(57) ABSTRACT

A fuel injector assembly for a combustor is provided, including a fuel nozzle having an axial inflow swirler and one or more radial inflow swirlers spaced radially outward of the downstream end of the fuel nozzle and mounted to the combustor, wherein the airstreams produced by the swirlers airblast atomize fuel films produced by the fuel nozzle.

16 Claims, 3 Drawing Sheets

(56) References Cited

U.S. PATENT DOCUMENTS 5,353,599 A * 10/1994 Johnson et al. ..... 60/748
5,417,070 A * 5/1995 Richardson ..... 60/748
5,481,867 A * 1/1996 Dubell et al. ..... F23C 7/02 60/39.27
5,490,378 A * 2/1996 Berger ..... F23R 3/26 60/39.23
5,603,211 A * 2/1997 Graves ..... 60/776
5,664,412 A * 9/1997 Overton ..... 60/39.23
5,749,219 A * 5/1998 DuBell ..... F02C 7/26 60/733
5,916,142 A * 6/1999 Snyder et al. ..... 60/748
5,966,937 A * 10/1999 Graves ..... 60/748
5,987,889 A * 11/1999 Graves et al. ..... 60/748
6,082,113 A 7/2000 Prociw et al.
6,141,968 A 11/2000 Gates et al.
6,161,387 A 12/2000 Green
6,240,731 B1 * 6/2001 Hoke ..... F23C 6/045 239/400
6,247,317 B1 6/2001 Kostka
6,272,840 B1 * 8/2001 Crocker et al. ..... 60/776
6,289,677 B1 9/2001 Prociw et al.
6,345,505 B1 2/2002 Green
6,367,262 B1 * 4/2002 Mongia et al. ..... 60/748
6,460,340 B1 * 10/2002 Chauvette et al. ..... 60/740
6,543,235 B1 4/2003 Crocker et al.
6,606,861 B2 8/2003 Snyder
6,625,971 B2 9/2003 Graves
6,708,498 B2 * 3/2004 Stickles et al. ..... 60/776
6,715,292 B1 4/2004 Hoke
6,823,677 B2 11/2004 Prociw et al.
6,834,505 B2 * 12/2004 Al-Roub et al. ..... 60/737
6,983,599 B2 * 1/2006 Young et al. ..... 60/722
6,993,916 B2 * 2/2006 Johnson et al. ..... 60/776
7,007,864 B2 3/2006 Snyder et al.
7,093,439 B2 8/2006 Pacheco-Tougas et al.
7,093,441 B2 8/2006 Burd et al.
7,104,066 B2 * 9/2006 Leen et al. ..... 60/740
7,114,337 B2 * 10/2006 Cazalens et al. ..... 60/737
7,334,410 B2 * 2/2008 Creighton et al. ..... 60/772
7,363,763 B2 4/2008 Coughlan, III et al.
7,533,532 B1 * 5/2009 Toon et al. ..... 60/740
7,568,345 B2 * 8/2009 Furletov et al. ..... 60/742
2002/0011064 A1 * 1/2002 Crocker et al. ..... 60/39.06
2003/0010034 A1 * 1/2003 Baudoin ..... F23R 3/286 60/740
2004/0040306 A1 3/2004 Prociw et al.
2004/0112061 A1 6/2004 Oskooei et al.
2005/0039458 A1 * 2/2005 Leen ..... F23C 7/004 60/748
2005/0144952 A1 7/2005 Prociw
2005/0188699 A1 9/2005 Shafique et al.
2005/0241319 A1 * 11/2005 Graves et al. ..... 60/776
2006/0218925 A1 10/2006 Prociw et al.
2006/0218926 A1 10/2006 Prociw et al.
2006/0260317 A1 11/2006 Prociw et al.
2007/0028619 A1 * 2/2007 Spooner ..... 60/737
2007/0084213 A1 4/2007 Burd et al.
2007/0119052 A1 * 5/2007 Caldwell et al. ..... 29/888.011
2007/0125093 A1 6/2007 Burd et al.
2008/0053062 A1 * 3/2008 Tuttle ..... 60/226.1
2008/0083841 A1 * 4/2008 Bainville et al. ..... 239/419.3
2008/0178598 A1 * 7/2008 Commaret ..... F23R 3/14 60/748
2008/0245075 A1 10/2008 Snyder
2008/0307791 A1 12/2008 Shum et al.
2009/0049840 A1 * 2/2009 Cayre ..... F23R 3/14 60/748
2009/0071158 A1 * 3/2009 Cazalens et al. ..... 60/737
2009/0212139 A1 * 8/2009 Thomson et al. ..... 239/590
2009/0293488 A1 12/2009 Coughlan, III et al.
2009/0320479 A1 12/2009 Prociw et al.
2010/0050646 A1 3/2010 Lovett et al.
2010/0307161 A1 12/2010 Thomson et al.
2011/0271682 A1 * 11/2011 Sandelis ..... F23C 7/004 60/737

FOREIGN PATENT DOCUMENTS

EP 0837284 A2 * 4/1998 ..... F23C 7/004
EP 0927854 A2 7/1999
EP 1253379 A2 * 10/2002 ..... F23R 3/14
EP 1507118 A2 * 2/2005 ..... F23R 3/10
EP 1923636 A1 * 5/2008 ..... F23R 3/14
GB 826961 A * 1/1960 ..... F23C 7/004
GB 2404976 A 2/2005

* cited by examiner

FUEL INJECTOR ASSEMBLY

BACKGROUND OF THE INVENTION

The subject matter disclosed herein relates generally to fuel injectors for gas turbine engines and more particularly to a fuel injector assembly.

Gas turbine engines, such as those used to power modern aircraft, to power sea vessels, to generate electrical power, and in industrial applications, include a compressor for pressurizing a supply of air, a combustor for burning a hydrocarbon fuel in the presence of the pressurized air, and a turbine for extracting energy from the resultant combustion gases. Generally, the compressor, combustor, and turbine are disposed about a central engine axis with the compressor disposed axially upstream or forward of the combustor and the turbine disposed axially downstream of the combustor. In operation of a gas turbine engine, fuel is injected into and combusted in the combustor with compressed air from the compressor thereby generating high-temperature combustion exhaust gases, which pass through the turbine and produce rotational shaft power. The shaft power is used to drive a compressor to provide air to the combustion process to generate the high energy gases. Additionally, the shaft power is used to, for example, drive a generator for producing electricity, or drive a fan to produce high momentum gases for producing thrust.

An exemplary combustor features an annular combustion chamber defined between a radially inboard liner and a radially outboard liner extending aft from a forward bulkhead. The radially outboard liner extends circumferentially about and is radially spaced from the inboard liner, with the combustion chamber extending fore to aft therebetween. A plurality of circumferentially distributed fuel injectors are mounted in the forward bulkhead and project into the forward end of the annular combustion chamber to supply the fuel to be combusted. Air swirlers proximate to the fuel injectors impart a swirl to inlet air entering the forward end of the combustion chamber at the bulkhead to provide rapid mixing of the fuel and inlet air.

Combustion of the hydrocarbon fuel in air in gas turbine engines inevitably produces emissions, such as oxides of nitrogen (NOx), which are delivered into the atmosphere in the exhaust gases from the gas turbine engine. In order to meet regulatory and customer requirements, engine manufacturers strive to minimize NOx emissions. An approach for achieving low NOx emissions makes use of a rich burning mixture in the combustor front end at high power. Such rich burning requires good mixing of fuel and air to control smoke at high power. The fuel injector must also provide a good fuel spray at low power for ignition, stability, and reduced emissions.

One solution for accommodating both high power and low power operations is the use of a conventional airblast fuel injector with an axial inflow swirler down the center of the fuel nozzle with radial inflow swirlers mounted to the tip of the fuel injector at the downstream end of the fuel nozzle. Having the radial inflow swirlers mounted to the tip of the fuel injector increases the size of the fuel injector, requiring more space in the dump gap between the diffuser and combustor in order to install and remove the fuel injector, which increases engine weight and cost. In addition, having the radial inflow swirlers mounted to the tip of the fuel injector makes the fuel injector heavier, which requires a thicker and heaver stem to support the fuel injector and minimize vibrations, thereby increasing the weight and cost of the fuel injector.

Another solution for accommodating both high power and low power operations is the use of a duplex fuel injector having a fuel nozzle surrounded by high shear air swirlers. The fuel nozzle of the fuel injector includes a primary pressure atomizing spray nozzle to provide an adequate fine primary fuel spray for ignition since, at ignition, there may be inadequate airflow shear to sufficiently atomize the fuel for reliable operation. This primary atomizing spray nozzle requires a valve at the base of the fuel injector to control flow between the primary and secondary fuel passages. So although the duplex fuel injector is lighter than the conventional airblast fuel injector having radial inflow swirlers mounted to the tip of the fuel injector eliminating some of the issues referenced previously, the external valve required by the duplex fuel injector increases the cost while reducing reliability of the duplex fuel injector.

BRIEF SUMMARY OF THE INVENTION

A fuel injector assembly for a combustor is provided, including a fuel nozzle having an axial inflow swirler and one or more radial inflow swirlers spaced radially outward of the downstream end of the fuel nozzle and mounted to the combustor, wherein the airstreams produced by the swirlers airblast atomize fuel films produced by the fuel nozzle.

According to one embodiment, a fuel injector assembly for a combustor is provided. The fuel injector assembly includes a fuel nozzle configured to inject fuel into the combustor, wherein the fuel nozzle comprises an axial inflow swirler configured to produce a first airstream into the combustor, and a first radial inflow swirler configured to produce a second airstream into the combustor, wherein the first radial inflow swirler is mounted to the combustor and spaced radially outward of the downstream end of the fuel nozzle.

In another embodiment, a fuel injector assembly for a combustor is provided. The fuel nozzle is configured to inject fuel into the combustor, wherein the nozzle comprises an axial inflow swirler configured to produce a first airstream into the combustor; a first radial inflow swirler configured to produce a second airstream into the combustor, wherein the first radial inflow swirler is mounted to the combustor and spaced radially outward of the downstream end of the fuel nozzle; and a second radial inflow swirler configured to produce a third airstream into the combustor, wherein the second radial inflow swirler is mounted to the combustor and spaced radially outward of the first radial inflow swirler.

BRIEF DESCRIPTION OF THE DRAWINGS

For a further understanding of the disclosure, reference will be made to the following detailed description which is to be read in connection with the accompanying drawing, wherein.

DETAILED DESCRIPTION OF THE INVENTION

Figure 1:
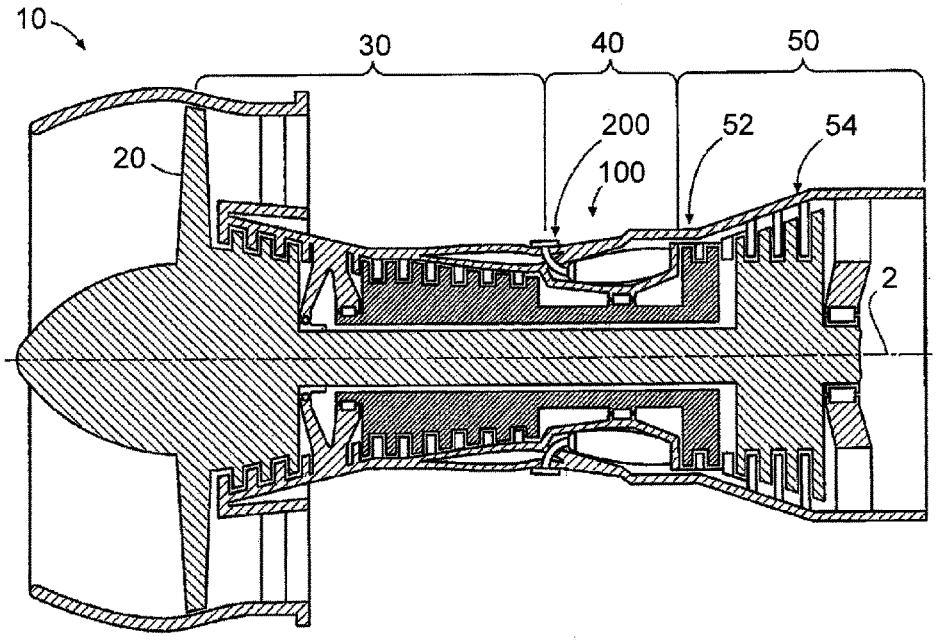
FIG. 1 is a schematic diagram of an exemplary embodiment of a gas turbine engine.

FIG. 1 is a schematic diagram of an exemplary embodiment of a gas turbine engine 10. The gas turbine engine 10 is depicted as a turbofan that incorporates a fan section 20, a compressor section 30, a combustion section 40, and a turbine section 50. The combustion section 40 incorporates a combustor 100 that includes an array of fuel injectors 200 that are positioned annularly about a centerline 2 of the engine 10 upstream of the turbines 52, 54. Throughout the application, the terms "forward" or "upstream" are used to refer to directions and positions located axially closer toward a fuel/air intake side of a combustion system than directions and positions referenced as "aft" or "downstream." The fuel injectors 200 are inserted into and provide fuel to one or more combustion chambers for mixing and/or ignition. It is to be understood that the combustor 100 and fuel injector 200 as disclosed herein are not limited in application to the depicted embodiment of a gas turbine engine 10, but are applicable to other types of gas turbine engines, such as those used to power modern aircraft, to power sea vessels, to generate electrical power, and in industrial applications.

Figure 2:
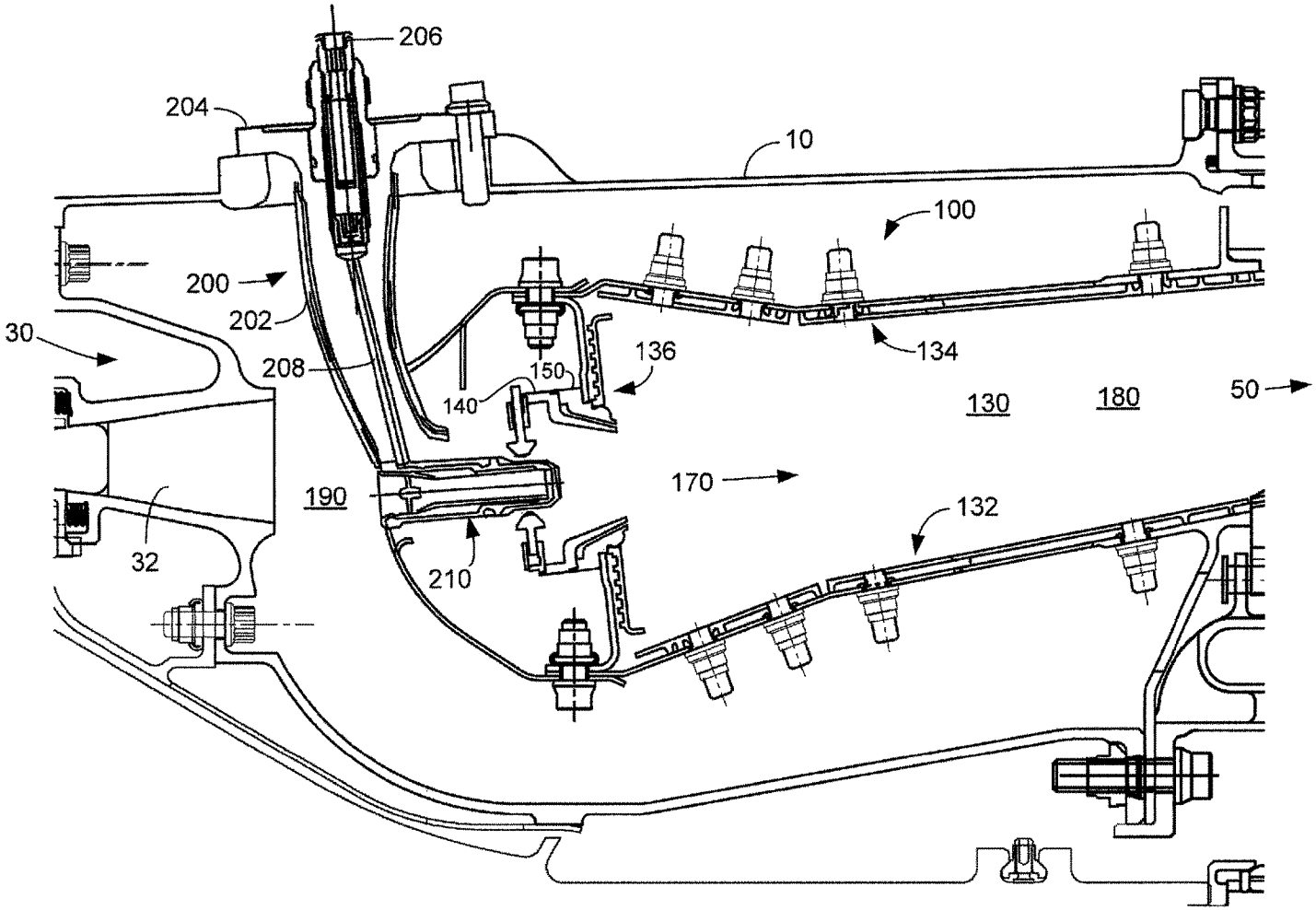
FIG. 2 is a sectional view of an exemplary embodiment of a combustor of a gas turbine engine.

FIG. 2 is a sectional view of an exemplary embodiment of a combustor 100 of a gas turbine engine 10. The combustor 100 positioned between the diffuser 32 of the compressor section 30 and the turbine section 50 of a gas turbine engine 10. The exemplary combustor 100 includes an annular combustion chamber 130 bounded by an inner (inboard) wall 132 and an outer (outboard) wall 134 and a forward bulkhead 136 spanning between the walls 132, 134. The bulkhead 136 of the combustor 100 includes a first radial inflow swirler 140 and second radial inflow swirler 150 proximate and surrounding the downstream end of an associated fuel nozzle 210 of a fuel injector 200. The first and second radial inflow swirlers 140, 150 are spaced radially outward of the fuel nozzle 210, with the second radial inflow swirler 150 spaced radially outward of the first radial inflow swirler 140. A number of sparkplugs (not shown) are positioned with their working ends along an upstream portion 180 of the combustion chamber 130 to initiate combustion of the fuel/air mixture. The combusting mixture is driven downstream within the combustor 100 along a principal flowpath 170 through a downstream portion 180 toward the turbine section 50 of the engine 10. As discussed previously, it is desirable to have the fuel injector 200 accommodate both high power and low power (e.g., ignition) operations, without necessarily increasing the size, weight, cost, and complexity of the fuel injector 200. A dump gap 190 located between the diffuser 32 and the combustor 100 provides adequate space in order to install and remove the fuel injector 200.

Figure 3:
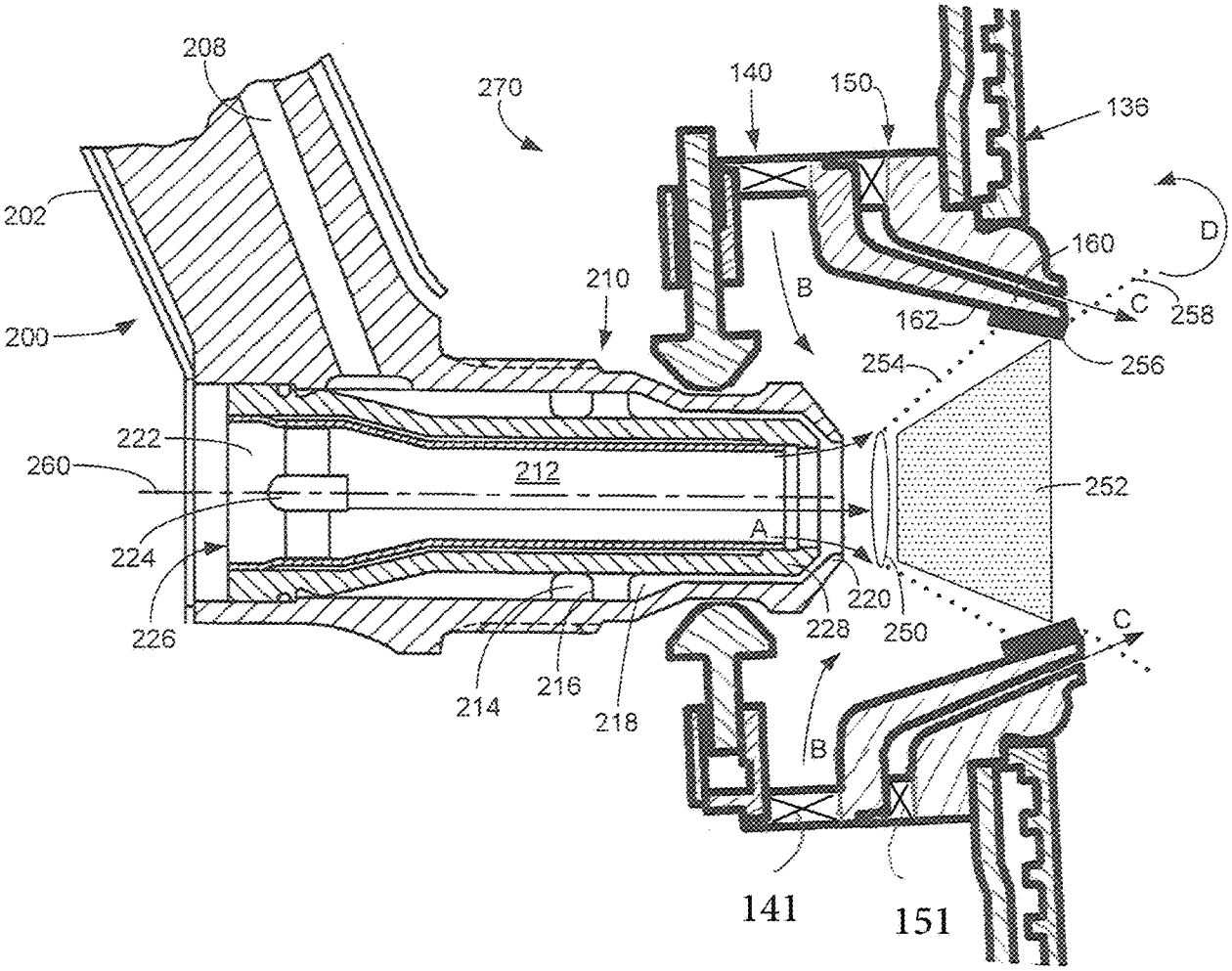
FIG. 3 is a sectional enlarged view of the exemplary fuel injector inserted into the exemplary combustor of FIG. 2 to form a fuel injector assembly.

As illustrated in FIG. 2 and in FIG. 3, a sectional enlarged view of the exemplary fuel injector 200 that injects fuel into the exemplary combustor 100 of FIG. 2 through the bulkhead 136 to form a fuel injector assembly 270, the exemplary fuel injector 200 has a fuel nozzle 210 connected to a base 204 by a stem 202. The base 204 has a fitting 206 for connection to a fuel source. A fuel delivery passage 208 delivers fuel to the fuel nozzle 210 through the stem 202. The fuel nozzle 210 is surrounded by the first radial inflow swirler 140 and the second radial inflow swirler 150 mounted to the bulkhead 136 of the combustor 100 to form a fuel injector assembly 270. A radial inflow swirler inner cone 160 separates the first radial inflow swirler 140 and the second radial inflow swirler 150. Since the first and second radial inflow swirlers 140, 150 are mounted to the bulkhead 136 of the combustor 100 in the fuel injector assembly 270, and not the fuel injector 200 as in prior airblast fuel injectors, the size and weight of the fuel injector 200 is greatly reduced.

The first and second radial inflow swirlers 140, 150 each have a plurality of vanes 141, 151 respectively, forming a plurality of air passages between the vanes for swirling air traveling through the swirlers to mix the air and the fuel dispensed by the fuel nozzle 210. The vanes 141 of the first radial inflow swirler 140 are oriented at an angle to cause the air to rotate in a first direction (e.g., clockwise) and to impart swirl to the radially inflowing airstream B. In one embodiment, the vanes 151 of the second radial inflow swirler 150 are oriented at an angle to cause the air to also rotate in a first direction (e.g., clockwise) and to impart swirl to the radially inflowing airstream C, co-swirling with airstream B. In another embodiment, the vanes 151 of the second radial inflow swirler 150 are oriented at an angle to cause the air to rotate in a second direction (e.g., counterclockwise), substantially opposite of the first direction, and to impart swirl to the radially inflowing airstream C, counter-swirling with airstream B to increase the turbulence of the air, improving mixing of fuel and air.

As will be described, the exemplary fuel injector assembly 270 creates films of fuel to enhance atomization and combustion performance as the fuel film is sheared between swirling airstreams, breaking up the fuel films into small droplets because of the shear and instability in the film, thereby producing fine droplets. This fuel filming enhancement breaks up fuel in a shorter amount of time and distance, minimizing the presence of large droplets of fuel that can degrade combustion performance. Referring to FIG. 3, the fuel delivery passage 208 delivers fuel to the fuel nozzle 210 through the stem 202 to a fuel distribution annulus 214, which feeds fuel to the angled holes of a fuel swirler 216 and into an annular passage fuel filmer 218 to fuel filmer lip 220, producing a swirling annular primary fuel film 250. The fuel swirler 216 imparts a circumferential momentum to and swirls the fuel upstream of the fuel filmer lip 220. The fuel nozzle 210 includes an axial inflow swirler 222, which includes an air passage 212 concentric to the centerline 260 of the fuel nozzle 210 with an inlet end 226 to receive axially inflowing airstream A, a vane assembly 224 to impart swirl to the axially inflowing airstream A, and an outlet end 228 proximate the fuel filmer lip 220. In one embodiment, the size and weight of the fuel injector 200 can be reduced by reducing the length of the fuel nozzle 210 (i.e., between the axial inflow swirler 222 and the fuel filmer lip 220) by shortening the length of the fuel filmer 218 and the air passage 212 downstream of the axial inflow swirler 222.

Swirling the fuel with fuel swirler 216 assists in the atomization process to help produce a thin annular primary fuel film 250 that can be carried through the air passage 212 of the fuel nozzle 210 by airstream A. In one embodiment, the fuel swirler 216 can swirl the fuel in the same direction as the swirl imparted to airstream A by the axial inflow swirler 222. The primary fuel film 250 is airblast atomized by the shear layer created between the axially inflowing airstream A of the nozzle air passage 212 and the radially inflowing airstream B of the first radial inflow swirler 140 creating a well mixed fuel spray 252 with small droplets. In one embodiment, airstream B rotates in the same direction as airstream A, causing the airstreams to be co-swirling. In another embodiment, airstream B rotates in substantially opposite of the direction of airstream A, causing counter-swirling. The high velocity swirling air on each side of the primary fuel film 250 creates a shear layer which atomizes the fuel and produces a rapidly mixing, downstream flowing fuel-air mixture. Even at low power, the fuel spray 252 provided by the fuel injector assembly 270 is sufficient to allow ignition and stability via delivery of fuel to the outer stabilization zone D without the need for a valve as in prior duplex fuel injectors.

Large primary droplets 254 formed within the fuel nozzle air passage 212 and not atomized by the shear layer created between the axially inflowing airstream A and the radially inflowing airstream B, reach a secondary fuel filmer 162 forming a secondary fuel film 256 on the inside of the radial inflow swirler inner cone 160 separating the first radial inflow swirler 140 and second radial inflow swirler 150. The secondary fuel film 256 is airblast atomized by the shear layer created between the radially inflowing airstream B of the first radial inflow swirler 140 and the radially inflowing airstream C of the second radial inflow swirler 150 creating a well mixed fuel spray (not shown) with small droplets. The high velocity swirling air on each side of the secondary fuel film 256 creates a shear layer which atomizes the fuel and produces a rapidly mixing, downstream flowing fuel-air mixture. Large secondary droplets 258 not atomized by the shear layer created between the radially inflowing airstream B and the radially inflowing airstream C are transported to the stability zone by airstream C.

The terminology used herein is for the purpose of description, not limitation. Specific structural and functional details disclosed herein are not to be interpreted as limiting, but merely as basis for teaching one skilled in the art to employ the present invention. While the present invention has been particularly shown and described with reference to the exemplary embodiments as illustrated in the drawing, it will be recognized by those skilled in the art that various modifications may be made without departing from the spirit and scope of the invention. Those skilled in the art will also recognize the equivalents that may be substituted for elements described with reference to the exemplary embodiments disclosed herein without departing from the scope of the present invention. Therefore, it is intended that the present disclosure not be limited to the particular embodiment(s) disclosed as, but that the disclosure will include all embodiments falling within the scope of the appended claims.

I claim:

1. A fuel injector assembly for a combustor comprising:

a fuel nozzle configured to inject fuel into the combustor, wherein the fuel nozzle comprises an axial inflow swirler arranged within a nozzle air passage configured to produce a first airstream into the combustor, a fuel filmer lip configured to form a first fuel film at a downstream end of the fuel nozzle, a fuel swirler disposed upstream of the fuel filmer lip and radially outward of the axial inflow swirler and located outside of the nozzle air passage, and a fuel filmer associated with the fuel swirler, the fuel filmer terminating proximate the fuel filmer lip, the fuel filmer proximate the downstream end of the fuel nozzle;

a first radial inflow swirler having a first plurality of vanes configured to produce a second airstream into the combustor, wherein the first radial inflow swirler is mounted to the combustor as opposed to the fuel nozzle and spaced radially outward of the downstream end of the fuel nozzle; and a radial inflow swirler cone extending from the vanes of the first radial inflow swirler through a bulkhead of the combustor and into a combustion chamber of the combustor.

2. The fuel injector assembly of claim 1, wherein the first fuel film is airblast atomized by a shear layer between the first airstream and the second airstream.

3. The fuel injector assembly of claim 1, further comprising a second fuel filmer on the radial inflow swirler cone to form a secondary fuel film on the radial inflow swirler cone, wherein the secondary fuel film is airblast atomized by a shear layer between the second airstream and a third airstream.

4. The fuel injector assembly of claim 1, further comprising:

a second radial inflow swirler configured to produce a third airstream into the combustor, wherein the second radial inflow swirler is mounted to the combustor as opposed to the fuel nozzle and spaced radially outward of the first radial inflow swirler;

wherein the first plurality of vanes form a first plurality of air passages, wherein the first plurality of vanes are oriented at an angle to cause the second airstream to rotate in a first direction; and the second radial inflow swirler comprises a second plurality of vanes forming a second plurality of air passages, wherein the second plurality of vanes are oriented at an angle to cause a third airstream to rotate in a second direction.

5. The fuel injector assembly of claim 4, wherein the first direction is substantially the same as the second direction.

6. The fuel injector assembly of claim 4, wherein the first direction is substantially opposite of the second direction.

7. A fuel injector assembly for a combustor comprising:

a fuel nozzle configured to inject fuel into the combustor, wherein the fuel nozzle comprises an axial inflow swirler arranged within a nozzle air passage configured to produce a first airstream into the combustor, a fuel filmer lip configured to form a first fuel film at a downstream end of the fuel nozzle, a fuel swirler disposed upstream of the fuel filmer lip and radially outward of the axial inflow swirler and located outside of the nozzle air passage, and a fuel filmer associated with the fuel swirler, the fuel filmer terminating proximate the fuel filmer lip, the fuel filmer proximate the downstream end of the fuel nozzle;

a first radial inflow swirler having a first plurality of vanes configured to produce a second airstream into the combustor, wherein the first radial inflow swirler is mounted to the combustor as opposed to the fuel nozzle and spaced radially outward of the downstream end of the fuel nozzle; and a second radial inflow swirler configured to produce a third airstream into the combustor, wherein the second radial inflow swirler is mounted to the combustor as opposed to the fuel nozzle and spaced from the first radial inflow swirler; and a radial inflow swirler cone separating the first radial inflow swirler and the second radial inflow swirler, being mounted to the combustor and extending from the first plurality of vanes through a bulkhead of the combustor and into a combustion chamber of the combustor.

8. The fuel injector assembly of claim 7, further comprising a secondary fuel filmer on the radial inflow swirler cone and configured to form on a secondary fuel film on a surface of the secondary fuel filmer, wherein the secondary fuel film is airblast atomized by a shear layer between the second airstream and the third airstream.

9. The fuel injector assembly of claim 7, wherein the first plurality of vanes form a first plurality of air passages and the first plurality of vanes are oriented at angle to cause the second airstream to rotate in a first direction; and the second radial inflow swirler comprises a second plurality of vanes forming a second plurality of air passages, wherein the second plurality of vanes are oriented at angle to cause the third airstream to rotate in a second direction.

10. The fuel injector assembly of claim 9, wherein the first direction is substantially the same as the second direction.

11. The fuel injector assembly of claim 9, wherein the first direction is substantially opposite of the second direction.

12. A fuel injector assembly for a combustor comprising:

a fuel nozzle configured to inject fuel into the combustor, wherein the fuel nozzle comprises an axial inflow swirler arranged within a nozzle air passage configured to produce a first airstream into the combustor;

a first radial inflow swirler configured to produce a second airstream into the combustor and to cause the first airstream to rotate in a first direction, wherein the first radial inflow swirler is mounted to the combustor as opposed to the fuel nozzle and spaced radially outward of a downstream end of the fuel nozzle;

a fuel filmer lip configured to form a first fuel film at the downstream end of the fuel nozzle, the fuel filmer lip proximate the downstream end of the fuel nozzle, wherein the first fuel film is airblast atomized by a shear layer between the first airstream and the second airstream; and a fuel swirler upstream of the fuel filmer lip configured to cause the fuel to rotate in a second direction, the fuel swirler disposed radially outward of the axial inflow swirler and located outside of the nozzle air passage;

a fuel filmer associated with the fuel swirler, the fuel filmer terminating proximate the fuel filmer lip; and a radial inflow swirler inner cone extending from vanes of the first radial inflow swirler through a bulkhead of the combustor and into a combustion chamber of the combustor.

13. The fuel injector assembly of claim 12, further comprising:

a second radial inflow swirler configured to produce a third airstream into the combustor, wherein the second radial inflow swirler is mounted to the combustor as opposed to the fuel nozzle with a downstream end of the second radial inflow swirler being spaced radially outward of a downstream end of the first radial inflow swirler.

14. The fuel injector assembly of claim 13, further comprising a secondary fuel filmer lip configured to form a secondary fuel film on a surface of the secondary fuel filmer lip, wherein the secondary fuel film is airblast atomized by a shear layer between the second airstream and the third airstream.

15. The fuel injector assembly of claim 12, wherein the first direction is substantially the same as the second direction.

16. The fuel injector assembly of claim 12, wherein the first direction is substantially opposite of the second direction.

* * * * *